US011075455B2

(12) United States Patent
Lu et al.

(10) Patent No.: US 11,075,455 B2
(45) Date of Patent: Jul. 27, 2021

(54) ANTENNA STRUCTURE, MANUFACTURING METHOD THEREOF AND COMMUNICATION DEVICE

(71) Applicant: BOE TECHNOLOGY GROUP CO., LTD., Beijing (CN)

(72) Inventors: Yongchun Lu, Beijing (CN); Xinyin Wu, Beijing (CN); Jianbo Xian, Beijing (CN); Yongda Ma, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 575 days.

(21) Appl. No.: 15/805,435

(22) Filed: Nov. 7, 2017

(65) Prior Publication Data

US 2018/0294562 A1 Oct. 11, 2018

(30) Foreign Application Priority Data

Apr. 6, 2017 (CN) ..... 201720353948.4

(51) Int. Cl.

| | |
|---|---|
| ***H01Q 1/52*** | (2006.01) |
| ***H01Q 1/38*** | (2006.01) |
| ***H01Q 9/04*** | (2006.01) |
| ***H01Q 1/40*** | (2006.01) |
| ***H01Q 1/36*** | (2006.01) |

(52) U.S. Cl.

CPC ..... *H01Q 1/52* (2013.01); *H01Q 1/36* (2013.01); *H01Q 1/38* (2013.01); *H01Q 1/405* (2013.01); *H01Q 9/0407* (2013.01)

(58) Field of Classification Search

CPC .. H01Q 1/38; H01Q 1/52; H01Q 1/36; H01Q 1/405; H01Q 9/0407

See application file for complete search history.

(56) References Cited

U.S. PATENT DOCUMENTS 4,803,450 A * 2/1989 Burgess ..... H01P 3/088 228/180.22
5,184,233 A * 2/1993 Lim ..... C09K 19/52 349/166
5,194,972 A * 3/1993 Lim ..... H03C 7/02 333/157

(Continued)

*Primary Examiner* — Dimary S Lopez Cruz
*Assistant Examiner* — Bamidele A Jegede
(74) *Attorney, Agent, or Firm* — Collard & Roe, P.C.

(57) ABSTRACT

An antenna structure, a manufacturing method thereof and a communication device are provided. The antenna structure includes a first base substrate, a second base substrate, a dielectric layer provided between the first base substrate and the second base substrate, an isolation layer, first coplanar electrodes provided on one side of the isolation layer facing the first base substrate, and second coplanar electrodes provided on another side of the isolation layer facing the second base substrate. In the direction perpendicular to the first base substrate, the dielectric layer includes a first dielectric layer and a second dielectric layer, and the isolation layer is provided between the first dielectric layer and the second dielectric layer. The first coplanar electrodes include first electrodes and second electrodes alternately arranged. The second coplanar electrodes include third electrodes and fourth electrodes alternately arranged.

15 Claims, 3 Drawing Sheets

(56) References Cited

U.S. PATENT DOCUMENTS 5,270,843 A * 12/1993 Wang ..... C09K 19/544 349/90
5,473,450 A * 12/1995 Yamada ..... G02F 1/133711 349/84
5,986,331 A * 11/1999 Letavic ..... H01L 23/66 257/347
6,304,306 B1 * 10/2001 Shiomi ..... C09K 19/544 349/88
6,667,134 B1 * 12/2003 Sutehrland ..... G03F 7/031 430/1
6,734,750 B1 * 5/2004 Ostergaard ..... H01P 3/088 333/1
6,821,457 B1 * 11/2004 Natarajan ..... G02B 6/2931 252/582
2001/0033400 A1 * 10/2001 Sutherland ..... C09K 19/544 359/15
2004/0191428 A1 * 9/2004 Tsuda ..... C09K 19/544 428/1.3
2004/0239444 A1 * 12/2004 Sledkov ..... H01Q 1/246 333/128
2006/0082423 A1 * 4/2006 Kim ..... H01P 1/181 333/158
2006/0119916 A1 * 6/2006 Sutherland ..... G02F 1/13342 359/34
2009/0061721 A1 * 3/2009 Isa ..... H01L 27/1218 445/24
2009/0109109 A1 * 4/2009 Franson ..... H01Q 1/38 343/770
2010/0025086 A1 * 2/2010 Stahr ..... H05K 3/4691 174/254
2010/0060844 A1 * 3/2010 Sawatari ..... G02F 1/133788 349/187
2010/0134397 A1 * 6/2010 Ishitani ..... G02F 1/133514 345/92
2010/0207857 A1 * 8/2010 Gu ..... G02F 1/133512 345/88
2010/0208172 A1 * 8/2010 Jang ..... B82Y 20/00 349/71
2010/0213521 A1 * 8/2010 Jeon ..... H01L 27/108 257/296
2011/0102720 A1 * 5/2011 Mizusaki ..... C08F 20/00 349/123
2011/0216257 A1 * 9/2011 Galstian ..... G02F 1/29 349/33
2012/0218500 A1 * 8/2012 Nakamura ..... G02F 1/133711 349/128
2014/0036183 A1 * 2/2014 Asatryan ..... G02F 1/139 349/33
2014/0266946 A1 * 9/2014 Bily ..... H01Q 13/22 343/771
2015/0028961 A1 * 1/2015 Carr ..... H01P 1/387 333/1.1
2015/0098599 A1 * 4/2015 Flood ..... H04R 25/48 381/315
2015/0380789 A1 * 12/2015 Jakoby ..... H01P 1/181 343/905
2016/0035800 A1 * 2/2016 Hsieh ..... H01L 27/1262 257/40
2016/0149441 A1 * 5/2016 Nayak ..... H02J 50/27 307/149
2016/0231604 A1 * 8/2016 Lin ..... G02F 1/1345
2016/0246115 A1 * 8/2016 Fan ..... G02F 1/133553
2017/0016930 A1 * 1/2017 Qiu ..... G02F 1/1339
2017/0093005 A1 * 3/2017 Ou ..... H01P 3/003
2018/0144710 A1 * 5/2018 Walker ..... G02F 1/1337

* cited by examiner

ANTENNA STRUCTURE, MANUFACTURING METHOD THEREOF AND COMMUNICATION DEVICE

CROSS-REFERENCES TO RELATED APPLICATIONS

Applicant claims priority under 35 U.S.C. § 119 of Chinese patent application No. 201720353948.4, filed on Apr. 6, 2017 with SIPO, and entitled "Antenna Structure and Communication Device", which is incorporated herein by reference in its entirety.

TECHNICAL FIELD

Embodiments of the present disclosure relate to an antenna structure, a manufacturing method thereof and a communication device.

BACKGROUND

To meet the development needs of the communication system, the antenna structure has gradually developed toward the technical directions of miniaturization, wide band, multi-band and high gain. Compared with the traditional horn, spiral, or doublet antenna, the new antenna structure tends to be smaller, flat and multi-standard.

The dielectric constant of liquid crystal molecules has anisotropy, and liquid crystals have advantages of low working voltage, low power consumption, low cost, and applicability for high frequency and miniaturized electromagnetic wave devices. Thus, liquid crystal dielectric tunable materials play a significant role in promoting the improvement of satellite communication system, and performances of the radio frequency identification, or the like.

SUMMARY

At least one embodiment of the present disclosure provides to an antenna structure, a manufacturing method thereof, and a communication device.

At least one embodiment of the present disclosure provides an antenna structure. The antenna structure comprises: a first base substrate; a second base substrate arranged opposite to the first base substrate; a dielectric layer provided between the first base substrate and the second base substrate; an isolation layer provided between the first base substrate and the second base substrate and configured to divide the dielectric layer into a first dielectric layer and a second dielectric layer in a direction perpendicular to the first base substrate; a plurality of first coplanar electrodes provided on one side of the isolation layer facing the first dielectric layer and including a plurality of first electrodes and a plurality of second electrodes alternately arranged; and a plurality of second coplanar electrodes provided on another side of the isolation layer facing the second dielectric layer and including a plurality of third electrodes and a plurality of fourth electrodes alternately arranged.

At least one embodiment of the present disclosure also provides communication device, comprising the antenna structure of the embodiments of the present disclosure.

At least one embodiment of the present disclosure also provides a method for manufacturing an antenna structure, comprising: providing a first base substrate and a second base substrate; filling a dielectric material between the first base substrate and the second base substrate; forming an isolation layer in the dielectric material, to form a first microcavity and a second microcavity in a space between the first base substrate and the second base substrate in a direction perpendicular to the first base substrate; and forming a plurality of first coplanar electrodes and a plurality of second coplanar electrodes respectively on two sides of the isolation layer, in which the plurality of first coplanar electrodes include a plurality of first electrodes and a plurality of second electrodes alternately arranged; and the plurality of second coplanar electrodes include a plurality of third electrodes and a plurality of fourth electrodes alternately arranged.

BRIEF DESCRIPTION OF THE DRAWINGS

Embodiments of the present disclosure will be described in detail hereinafter in conjunction with accompanying drawings to allow one of ordinary skill in the art to understand the present disclosure more clearly, in which.

DETAILED DESCRIPTION

Figure 1:
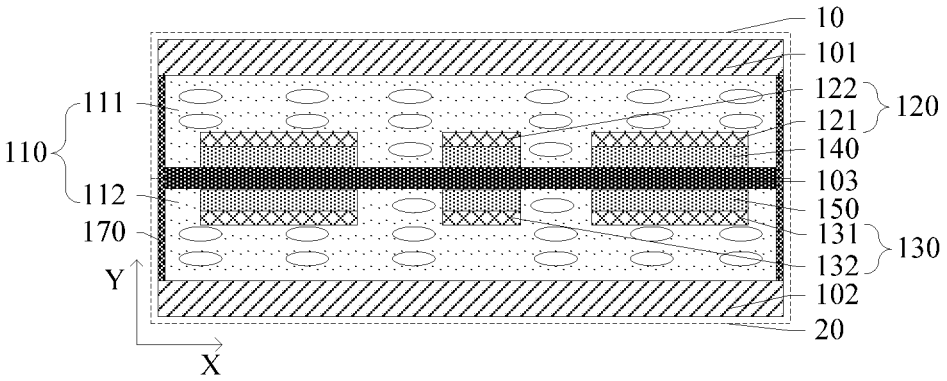
FIG. 1 is a schematic partial view of an antenna structure provided by an embodiment of the present disclosure.

In order to make objects, technical details and advantages of the embodiments of the disclosure apparent, the technical solutions according to the embodiments of the present disclosure will be described clearly and understandable as below in conjunction with the accompanying drawings of embodiments of the present disclosure. It is apparent that the described embodiments are only a part of but not all of exemplary embodiments of the present disclosure. Based on the described embodiments of the present disclosure, various other embodiments can be obtained by those of ordinary skill in the art without creative labor and those embodiments shall fall within the scope of the present disclosure.

Unless otherwise defined, all the technical and scientific terms used herein have the same meanings as commonly understood by one of ordinary skill in the art to which the present disclosure belongs. The terms, such as "first," "second," or the like, which are used in the description and the claims of the present application, are not intended to indicate any sequence, amount or importance, but for distinguishing various components. Also, the terms, such as "comprise/comprising," "include/including," or the like are intended to specify that the elements or the objects stated before these terms encompass the elements or the objects and equivalents thereof listed after these terms, but not preclude other elements or objects. The terms, "on," "under," "left," "right," or the like are only used to indicate relative position relationship, and when the position of the object which is described is changed, the relative position relationship may be changed accordingly.

At least one embodiment of the present disclosure provides an antenna structure and a communication device. The antenna structure includes a first base substrate; a second base substrate arranged opposite to each other; a dielectric layer disposed between the first base substrate and the second base substrate; an isolation layer disposed between the first base substrate and the second base substrate and configured to divide the dielectric layer into a first dielectric layer and a second dielectric layer in the direction perpendicular to the first base substrate; a plurality of first coplanar electrodes disposed on one side of the isolation layer facing the first dielectric layer and including a plurality of first electrodes and a plurality of second electrodes which are alternately arranged; and a plurality of second coplanar electrodes disposed on another side of the isolation layer facing the second dielectric layer and including a plurality of third electrodes and a plurality of fourth electrodes which are alternately arranged. The antenna structure adopts the isolation layer to divide the dielectric layer into the first dielectric layer and the second dielectric layer and can realize the transmission and reception of double-sided electromagnetic waves without increasing the thickness of the antenna structure, and the isolation layer can avoid the mutual interference of electromagnetic waves in two microcavities provided with the first dielectric layer and the second dielectric layer therein, respectively.

Description will be given below to the antenna structure and the communication device, provided by the embodiment of the present disclosure, with reference to the accompanying drawings.

First Embodiment

The embodiment provides an antenna structure. FIG. 1 is a schematic partial view of the antenna structure provided by the embodiment. As illustrated in FIG. 1, the antenna structure comprises a first base substrate 101, a second base substrate 102 arranged opposite to the first base substrate 101, a dielectric layer 110 disposed between the first base substrate 101 and the second base substrate 102, and an isolation layer 103 disposed between the first base substrate 101 and the second base substrate 102. The isolation layer 103 divides the dielectric layer 110 into a first dielectric layer 111 and a second dielectric layer 112 in the direction perpendicular to the first base substrate 101, namely in the Y direction in FIG. 1.

As shown in FIG. 1, the isolation layer 103 divides the antenna structure into a first microcavity structure 10 and a second microcavity structure 20, namely two microcavity structures marked by dotted lines in the figure, along the Y direction. The first microcavity structure 10 and the second microcavity structure 20 here share the isolation layer 103. The antenna structure provided by the embodiment does not need to stack two independent antenna resonant cavities but adopts the isolation layer to divide one antenna resonant cavity into two microcavity structures, namely it can realize the transmission and reception of double-sided electromagnetic waves without increasing the thickness of the antenna structure. Meanwhile, the isolation layer can also avoid the mutual interference of electromagnetic waves in the first microcavity structure and the second microcavity structure.

As illustrated in FIG. 1, the antenna structure also comprises a plurality of first coplanar electrodes 120 disposed on one side of the isolation layer 103 facing the first dielectric layer 111 and including a plurality of first electrodes 121 and a plurality of second electrodes 122 which are alternately arranged along the X direction; and a plurality of second coplanar electrodes 130 disposed on another side of the isolation layer 103 facing the second dielectric layer 112 and including a plurality of third electrodes 131 and a plurality of fourth electrodes 132 which are alternately arranged along the X direction. It is noted that the size of the first electrodes and the second electrodes in the first coplanar electrodes as shown in FIG. 1 along the X direction is shown schematically. In order to distinguish two different electrodes, the size relationship of the electrodes is designed according to actual demands. Similarly, the size of the third electrodes and the fourth electrodes in the second coplanar electrodes along the X direction is also shown schematically.

For instance, the first base substrate 101 and the second base substrate 102 are flexible substrates. For instance, the first base substrate 101 and the second base substrate 102 may be made of a material selected from the group consisting of polyimide, polycarbonate, polyacrylate, polyetherimide, polyether sulfone, polyethylene terephthalate, and polyethylene naphthalate. The embodiment includes but not limited thereto. The antenna structure, comprising the first flexible substrate and the second flexible substrate, provided by the embodiment, is a flexible antenna structure, it is applicable in radio frequency identification products, such as flexible e-tickets, flexible electronic identification cards, and small item identifications. In this way, it can realize the flexibility of flexible electronic devices.

For instance, the first coplanar electrodes 120 include metal electrodes, and the second coplanar electrodes 130 include metal electrodes. For instance, the materials of the metal electrodes may adopt one or more materials selected from the group consisting of titanium (Ti), aluminum (Al), nickel (Ni), platinum (Pt), gold (Au), or the like.

For instance, the materials of the isolation layer 103 include conductive polymer composite materials. The embodiment includes but not limited thereto. For instance, the conductive polymer composite materials of the isolation layer 103 include graphite, or carbon nanotubes of conductive polymer composite materials, in which polymers for cladding graphite, or carbon nanotubes may adopt organic polymer materials with good viscoelasticity, for example. Description is given in the embodiment exemplarily by the instance that the materials of the isolation layer 103 are graphite/polyetherimide conductive polymer composite materials, or oxidized graphite/polyetherimide conductive polymer composite materials. The isolation layer made of the materials can effectively avoid the mutual interference of the electromagnetic waves in the first microcavity structure 10 and the second microcavity structure 20 and effectively achieve the accuracy and the speed of double-sided radio frequency identification. In addition, the oxidized graphite/polyetherimide conductive polymer composite materials have good flexibility and are applicable to flexible electronic devices, such as flexible antenna structures.

For instance, as shown in FIG. 1, the antenna structure provided by the embodiment also comprises first buffer blocks 140 disposed between the first coplanar electrodes 120 and the isolation layer 103, and second buffer blocks 150 disposed between the second coplanar electrodes 130 and the isolation layer 103. Description is given in the embodiment exemplarily by the instance that an orthographic projection of the first coplanar electrode 120 on the isolation layer 103 is completely coincident with an orthographic projection of the first buffer block 140 on the isolation layer 103 and an orthographic projection of the second coplanar electrode 130 on the isolation layer 103 is completely coincident with an orthographic projection of the second buffer block 150 on the isolation layer 103. In this instance, when the vertical distance between the first base substrate 101 (the second base substrate 102) and the isolation layer 103 is constant, the thickness of the first dielectric layer 111 (the second dielectric layer 112) along the Y direction may be basically consistent with the vertical distance between the first base substrate 101 (the second base substrate 102) and the isolation layer 103, so that the thickness of the antenna structure can be decreased while it permits a proper thickness of the dielectric layer. But the embodiment is not limited thereto. For instance, at least one of the first buffer block, or the second buffer block may be an integral buffer layer disposed on the isolation layer (in this case, the buffer block is not patterned, it is disposed on the isolation layer in an integral manner), to allow the orthographic projection of the first coplanar electrode on the isolation layer falls within the orthographic projection of the first buffer block on the isolation layer and the orthographic projection of the second coplanar electrode on the isolation layer falls within the orthographic projection of the second buffer block on the isolation layer.

For instance, the materials of at least one of the first buffer block 140 or the second buffer block 150 include an organic polymer dielectric material. The buffer block made of the organic polymer dielectric material can avoid the electromagnetic interference of the electromagnetic waves in the double-sided microcavity structures as signals transmitted on the metal electrodes are directly transmitted into the conductive isolation layer due to direct contact between the coplanar metal electrodes and the conductive isolation layer. Moreover, the materials of at least one of the first buffer block or the second buffer block select organic polymers with good viscoelasticity, so as to avoid the separation, deformation and the like of the coplanar metal electrodes when the antenna structure is subjected to an external force.

For instance, adjustable dielectric media in the dielectric layer 110 may be polymer dispersed liquid crystals (PDLCs), namely nematic liquid crystal molecules are uniformly dispersed in a solid organic polymer matrix in the form of droplets of micron size. The embodiment adopts the PDLCs as the material of the dielectric layer, which is advantageous in effectively reducing the process difficulty, and being easy in integration, and the like. It can keep the uniformity of the liquid crystals in a liquid crystal cavity when the flexible liquid crystal antenna structure is subjected to an external force. In this way, it can avoid the problems of radiation direction distortion, affecting of the signal transmission path and speed of the antenna, and the like, due to the uneven thickness of a liquid crystal layer in the liquid crystal cavity caused by the external force.

Figure 2:
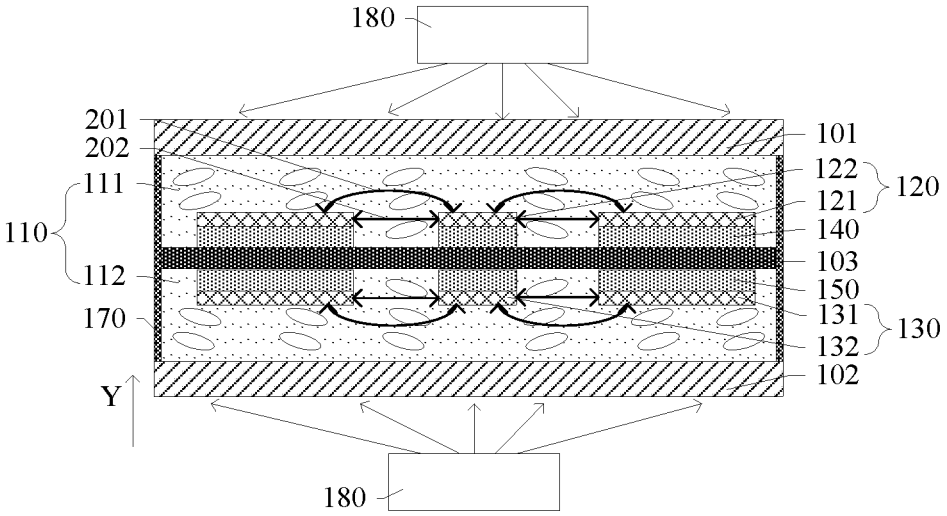
FIG. 2 is a schematic diagram illustrating electric field directions of the antenna structure provided by an embodiment of the present disclosure.

FIG. 2 is a schematic diagram illustrating the electric field directions of the antenna structure provided by the embodiment. As shown in FIG. 2, for instance, the electric conductivity of the first coplanar electrodes 120 and the second coplanar electrodes 130 including metallic materials is $10^{-6}$ S/cm. For instance, the electric conductivity of the isolation layer 103 including the oxidized graphite/polyetherimide conductive polymer composite materials is $10^{-11}$-$10^{-10}$ S/cm. The electric resistivity of the isolation layer 103 is higher than the electric resistivity of the first coplanar electrodes 120 and the second coplanar electrodes 130. In this way, the electromagnetic waves in the first microcavity structure and the second microcavity structure are preferably transmitted in the coplanar metal electrodes, and the conductive isolation layer will not affect scheduled electromagnetic wave radiation.

For instance, when electric fields are produced on one side of the first coplanar electrodes 120 (the second coplanar electrodes 130) facing the isolation layer 103, unscheduled electromagnetic radiation will be created in the liquid crystal microcavity structure; furthermore, a few part of liquid crystals cannot be deflected according to the preset direction due to overlarge external force, which will also result in the unscheduled electromagnetic radiation. The isolation layer 103 including the graphite/polyetherimide materials can adopt a chemical preparation method to allow a cavity structure to be formed in the layer. In this way, unscheduled electromagnetic waves will be absorbed by the isolation layer 103 once being transmitted to a surface of the isolation layer 103, and the absorbed unscheduled electromagnetic waves are dispersed and attenuated in the cavity of the isolation layer 103, so as to avoid the mutual interference of the electromagnetic wave radiation in the first microcavity structure and the second microcavity structure.

For instance, as shown in FIG. 2, the orthographic projection of the first coplanar electrode 120 on the isolation layer 103 is completely coincident with the orthographic projection of the second coplanar electrode 130 on the isolation layer 103. In this case, the electric fields produced on one side of the first coplanar electrodes 120 facing the isolation layer 103 and the electric fields produced on one side of the second coplanar electrodes 130 facing the isolation layer 103 are relatively symmetrically distributed relative to the isolation layer 103. In this way, less unscheduled electromagnetic radiation is created by the respective distribution of the electric fields of the first coplanar electrodes 120 and the second coplanar electrodes 130. The embodiment is described exemplarily by the instance that the first coplanar electrodes 120 and the second coplanar electrodes 130 are symmetrically arranged relative to the isolation layer 103, which can reduce the quantity of unscheduled electromagnetic radiation caused by the distribution of the electric fields of the coplanar electrodes as much as possible. The embodiment includes but not limited thereto. For instance, the orthographic projection of the first coplanar electrode on the isolation layer may also be set to fall within the orthographic projection of the second coplanar electrode on the isolation layer, or the orthographic projection of the first coplanar electrode on the isolation layer may also be set to partially fall within the orthographic projection of the second coplanar electrode on the isolation layer. The embodiment of the present disclosure is not limited thereto.

For instance, as shown in FIG. 2, the vertical distance from the first base substrate 101 to the isolation layer 103 is equal to the vertical distance from the second base substrate 102 to the isolation layer 103, namely the isolation layer 103 is disposed at an intermediate position between the first base substrate 101 and the second base substrate 102 along the Y direction. As the thickness of the antenna structure along the Y direction will affect the reception and radiation effects of the electromagnetic waves, in the embodiment, the vertical distance from the first base substrate to the isolation layer is set to be equal to the vertical distance from the second base substrate to the isolation layer, to allow the thickness of the second microcavity structure and the first microcavity structure arranged along the Y direction to reach the optimum thickness, so that the reception and radiation of the electromagnetic waves can be realized. For instance, the optimum thickness of the two microcavity structures along the Y direction is about 5-20 μm. The embodiment includes but not limited thereto.

For instance, as shown in FIG. 2, description is given here exemplarily by the first coplanar electrodes 120. For instance, the first electrodes 121 of the first coplanar electrodes 120 are ground electrodes and the second electrodes 122 are signal electrodes. A voltage is applied to both the first electrode 121 and the second electrode 122, so as to produce a spatial electric field 201 and a horizontal electric field 202 between the first electrode 121 and the second electrode 122 which are adjacent to each other. The rotation angle of the liquid crystal molecules can be rapidly and effectively adjusted when the PDLCs are under the action of the electric fields, so as to realize the adjustment of the dielectric constant of the liquid crystal molecules. It is noted that the working principle of the second coplanar electrodes 130 is the same as the working principle of the first coplanar electrodes 120. No further description will be given here.

For instance, a semiconductor drive element may also be adopted. For instance, thin-film transistors (TFTs) are connected with the first coplanar electrodes 120 or the second coplanar electrodes 130 one to one correspondingly. Each electrode may be independently controlled to adjust the dielectric constant of the liquid crystal molecules at different positions.

For instance, an alignment film may also be disposed on one side of the first base substrate and the second base substrate facing the dielectric layer, respectively, so as to align the deflection direction of the liquid crystal molecules in the dielectric layer.

For instance, as shown in FIG. 2, the antenna structure provided by the embodiment also comprises a feed source 180. The feed source 180 is disposed on one side of the first base substrate 101 away from the isolation layer 103 or one side of the second base substrate 102 away from the isolation layer 103. For instance, electromagnetic waves emitted by an external electromagnetic wave emission source are fed into the antenna structure through the feed source 180, and predetermined electric fields are created by inputting control signals into the first coplanar electrodes 120 or the second coplanar electrodes 130 through external control units to adjust the dielectric constant of the liquid crystal molecules in the first dielectric layer 111 or the second dielectric layer 112 to be a preset value, so as to receive the electromagnetic waves with preset receiving frequency and direction fed by the feed source 180. The principle of selectively emitting the electromagnetic waves of the antenna structure is similar to the principle of selectively receiving the electromagnetic waves.

For instance, as shown in FIG. 2, the first base substrate 101, the second base substrate 102 and the isolation layer 103 are arranged in parallel to each other. The embodiment includes but not limited thereto. For instance, one side of at least one of the first base substrate or the second base substrate facing the isolation layer is designed in curve manner, namely the cross section of at least one of the first microcavity structure or the second microcavity structure may be in a shape of a circular arc, or the like. The embodiment of the present disclosure is not limited thereto.

Second Embodiment

The embodiment provides a method for manufacturing an antenna structure. FIGS. 3*a*-4*d* are flow diagrams illustrating the manufacturing processes of the antenna structure provided by the embodiment.

Figure 3A:
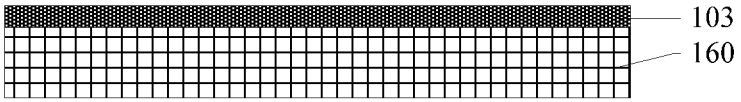
FIGS. 3*a*-3*e* are flow diagrams illustrating the manufacturing processes of a microcavity structure of the antenna structure provided by an embodiment of the present disclosure.

For instance, as shown in FIG. 3*a*, a rigid substrate 160 is provided, and an isolation layer 103 prepared by a chemical method is disposed on the rigid substrate 160. For instance, a graphite conductive polymer composite material may be formed by the catalytic polymerization of graphite and at least one polymer monomer, and then, the graphite conductive polymer composite material is transferred onto a rigid substrate 160. Description is given in the embodiment exemplarily by the instance that the isolation layer 103 includes the graphite conductive polymer composite material, but the embodiment is not limited thereto. For instance, the isolation layer may also include carbon nanotubes of conductive polymer composite materials.

Figure 3B:
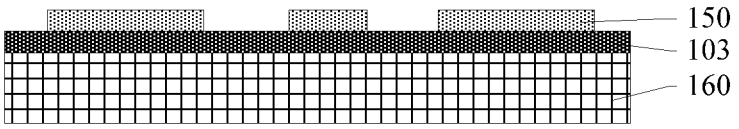

For instance, as shown in FIG. 3*b*, second buffer blocks 150 are transferred to one side of the isolation layer 103 away from the rigid substrate 160 by a patterning process, such as transfer printing. The embodiment includes but not limited thereto. For instance, the second buffer blocks 150 may also be formed by patterning processes, such as film forming, exposure, and etching.

Figure 3C:
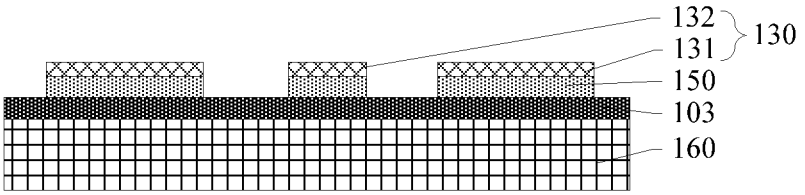

For instance, as shown in FIG. 3*c*, a plurality of second coplanar electrodes 130 are formed on one side of the second buffer blocks 150 away from the isolation layer 103 by a patterning process, such as transfer printing. The plurality of second coplanar electrodes 130 include a plurality of third electrodes 131 and a plurality of fourth electrodes 132 which are alternately arranged. Description is given in the embodiment exemplarily by the instance that an orthographic projection of the second coplanar electrode 130 on the isolation layer 103 is completely coincident with an orthographic projection of the second buffer block 150 on the isolation layer 103. But the embodiment is not limited thereto. For instance, the second buffer blocks may also be an integral buffer layer disposed on the isolation layer 103 (in this case, the second buffer blocks are not patterned, it is formed on the isolation layer in an integral form), so as to allow the orthographic projection of the second coplanar electrode 130 on the isolation layer 103 falls within the orthographic projection of the second buffer block 150 on the isolation layer 103.

Figure 3D:
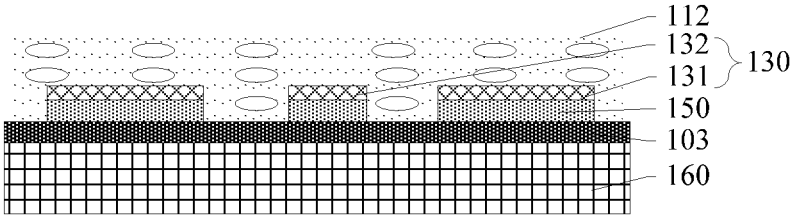

For instance, as shown in FIG. 3*d*, a second dielectric layer 112 is formed on a surface of the isolation layer 103 provided with the second coplanar electrodes 130 and the second buffer blocks 150. Description is given in the embodiment exemplarily by the instance that the second dielectric layer 112 includes PDLCs. A liquid crystal/pre-polymer system is added onto the surface of the isolation layer 103 provided with the second coplanar electrodes 130 and the second buffer blocks 150. Under the action of materials, such as light trigger, photosencitizer and cross-linking agent, the liquid crystal/pre-polymer system is subjected to photopolymerization by ultraviolet exposure, and pre-polymers and liquid crystal droplets in the liquid state are subjected to two-phase separation. At this point, the pre-polymers are cured and polymerized to form polymers; while the liquid crystals are quickly precipitated; and the liquid crystal droplets in the liquid state are encircled in a polymer network to form a PDLC layer. The embodiment adopts the PDLCs as the dielectric layer, to permit the uniformity of liquid crystals in a liquid crystal cavity when the liquid crystal antenna structure is under the action of an external force, and avoid the problems of radiation direction distortion, the signal transmission path and speed of the antenna being affected, and the like, due to the uneven thickness of a liquid crystal layer in the liquid crystal cavity caused by the external force.

Figure 3E:
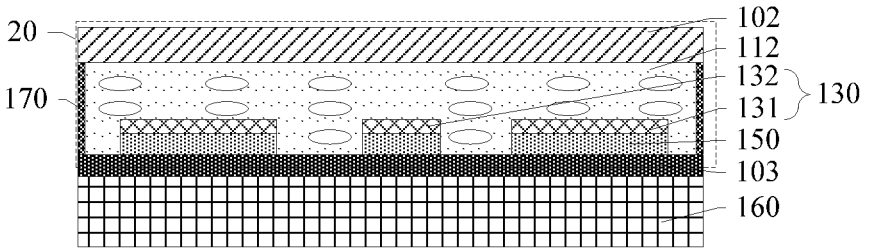

For instance, as shown in FIG. 3*e*, a second base substrate 102 is disposed on the second dielectric layer 112, and subsequently sealant 170 is coated around the second dielectric layer 112 for sealing and connecting the second base substrate 102 and the isolation layer 103, so as to form a second microcavity structure 20.

Figure 4A:
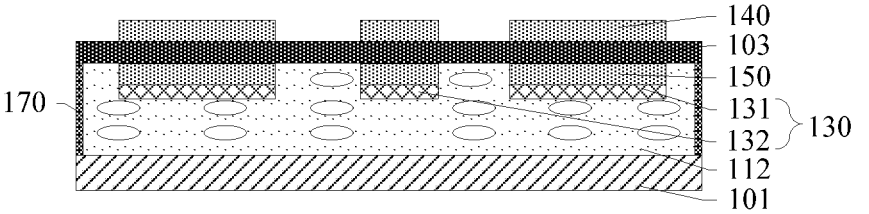
FIGS. 4*a*-4*d* are flow diagrams illustrating the manufacturing processes of a second microcavity structure of the antenna structure provided by an embodiment of the present disclosure.

For instance, as shown in FIG. 4*a*, after the second microcavity structure 20 is formed, the rigid substrate 160 is stripped off. Subsequently, first buffer blocks 140 are transferred to one side of the isolation layer 103 away from the second dielectric layer 112 by a patterning process, such as transfer printing. Description is given in the embodiment exemplarily by the instance that an orthographic projection of the first buffer block 140 on the isolation layer 103 is completely coincident with the orthographic projection of the second buffer block 150 on the isolation layer 103 and the first buffer block 140 and the second buffer block 150 are symmetrically arranged relative to the isolation layer 103. The embodiment includes but not limited thereto. For instance, the first buffer blocks may also be an integral buffer layer disposed on the isolation layer 103 (in this case, the first buffer blocks are not patterned, it is formed on the isolation layer in an integral manner).

Figure 4B:
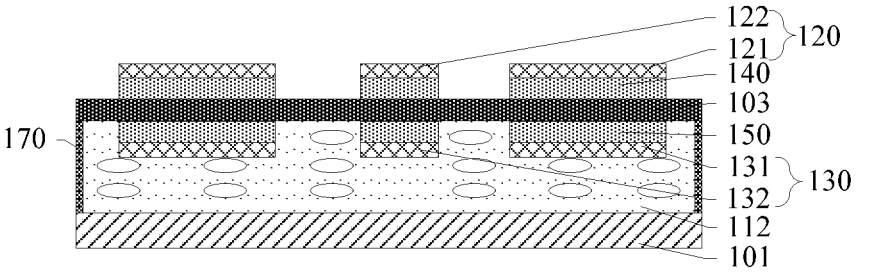

For instance, as shown in FIG. 4*b*, a plurality of first coplanar electrodes 120 are disposed on one side of the first buffer blocks 140 away from the isolation layer 103 by a patterning process, such as transfer printing. The plurality of first coplanar electrodes 120 include a plurality of first electrodes 121 and a plurality of second electrodes 122 which are alternately arranged. Description is given in the embodiment exemplarily by the instance that an orthographic projection of the first coplanar electrode 120 on the isolation layer 103 is completely coincident with the orthographic projection of the first buffer block 140 on the isolation layer 103. The embodiment is not limited thereto.

For instance, the first coplanar electrodes 120 include metal electrodes, and the second coplanar electrodes 130 include metal electrodes. For instance, the materials of the metal electrodes may be selected from the group consisting of Ti, Al, Ni, Pt, Au, or the like. The embodiment of the present disclosure is not limited thereto.

For instance, the materials of at least one of the first buffer block 140 or the second buffer block 150 include an organic polymer material. The embodiment of the present disclosure is not limited thereto. The material of at least one of the first buffer block or the second buffer block made of the organic polymer materials selects an organic polymer with proper viscoelasticity, so as to avoid the separation, deformation, and the like of the coplanar metal electrodes when the antenna structure is under the action of an external force.

Figure 4C:
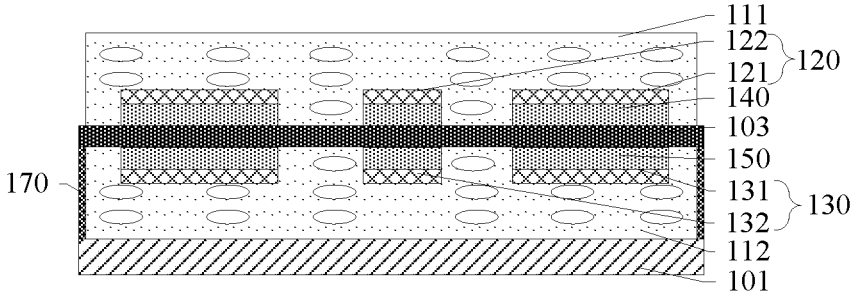

For instance, as shown in FIG. 4*c*, a first dielectric layer 111 is formed on a surface of the isolation layer 103 provided with the first coplanar electrodes 120 and the first buffer blocks 140. Moreover, the first dielectric layer 111 is made of a same material as that of the second dielectric layer 112 and is formed by same method steps.

Figure 4D:
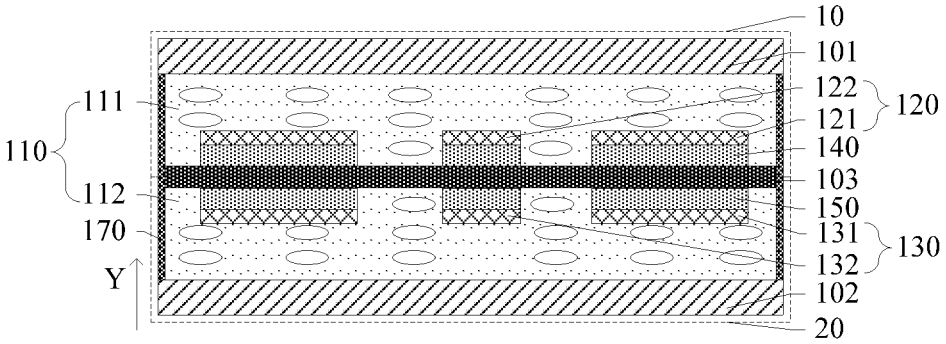

For instance, as shown in FIG. 4*d*, a first base substrate 101 is disposed on the first dielectric layer 111, and subsequently, sealant 170 is coated around the first dielectric layer 111 for sealing and connecting the first base substrate 101 and the isolation layer 103, so as to form a first microcavity structure 10. The embodiment includes but not limited thereto. For instance, the sealant 170 may not be coated around the second dielectric layer 112 after the second base substrate 102 is disposed on the second dielectric layer 112, instead, the sealant 170 is simultaneously coated around the first dielectric layer 111 and the second dielectric layer 112 after the first base substrate 101 is disposed on the first dielectric layer 111, so as to form the first microcavity structure 10 and the second microcavity structure 20.

For instance, the first base substrate 101 and the second base substrate 102 are flexible substrates. The antenna structure of the embodiment comprising the flexible first base substrate and the flexible second base substrate is a flexible antenna structure, which can be applied to radio frequency identification products, such as flexible e-tickets, flexible electronic identification cards, and small item identifications, in this way, it can realize the flexibility of flexible electronic devices.

Third Embodiment

The embodiment provides a communication device, which comprises any antenna structure provided by the first embodiment. It can realize the transmission and reception of double-sided electromagnetic waves without increasing the thickness of the antenna structure. Moreover, the isolation layer can avoid the mutual interference of electromagnetic waves in upper and lower microcavities. Meanwhile, the filling of PDLCs in the liquid crystal cavity can avoid the problem of radiation direction distortion due to uneven thickness of the liquid crystal layer in the liquid crystal cavity caused by the external force.

The following points should be noted:

(1) The accompanying drawings in the embodiments of the present disclosure only involve structures relevant to the embodiments of the present disclosure, and other structures may refer to common design(s).

(2) Without conflict with each other, the features in different embodiments, or the same embodiment of the present disclosure may be combined.

(3) For clarity, in the accompanying drawings of the embodiments of the present disclosure, the thickness of layers or regions is enlarged or reduced. That is, the accompanying drawings are not drawn according to actual scales. It should be understood that: in an instance that an element, such as a layer, a film, a region, or a substrate is referred to as being disposed "on" or "under" another element, the element may be "directly" disposed "on" or "under" another element, or an intermediate element may be provided.

The described above are only exemplary embodiments of the present disclosure, and the present disclosure is not limited thereto. For one of ordinary skill in the art, various changes and alternations may be readily contemplated without departing from the technical scope of the present disclosure, and all of these changes and alternations shall fall within the scope of the present disclosure.

What is claimed is:

1. An antenna structure, comprising:

a first base substrate;

a second base substrate arranged opposite to the first base substrate;

a dielectric layer provided between the first base substrate and the second base substrate;

an isolation layer provided between the first base substrate and the second base substrate and configured to divide the dielectric layer into a first dielectric layer and a second dielectric layer in a direction perpendicular to the first base substrate;

a plurality of first coplanar electrodes provided on one side of the isolation layer facing the first dielectric layer and including a plurality of first electrodes and a plurality of second electrodes alternately arranged;

a plurality of second coplanar electrodes provided on another side of the isolation layer facing the second dielectric layer and including a plurality of third electrodes and a plurality of fourth electrodes alternately arranged;

wherein the plurality of first coplanar electrodes is disposed orthogonally opposite the plurality of second coplanar electrodes;

a plurality of first separate buffer blocks provided between the first coplanar electrodes and the isolation layer; and a plurality of second separate buffer blocks provided between the second coplanar electrodes and the isolation layer;

wherein materials of at least one of the first buffer blocks or the second buffer blocks include an organic polymer material.

2. The antenna structure according to claim 1, wherein the dielectric layer includes polymer dispersed liquid crystals (PDLCs).

3. The antenna structure according to claim 1, wherein the first base substrate and the second base substrate are flexible substrates.

4. The antenna structure according to claim 1, wherein a material of the isolation layer includes a conductive polymer composite material.

5. The antenna structure according to claim 4, wherein the first coplanar electrodes include metal electrodes, and the second coplanar electrodes include metal electrodes.

6. The antenna structure according to claim 1, wherein the orthographic projection of the first coplanar electrode on the isolation layer is completely coincident with the orthographic projection of the corresponding second coplanar electrode on the isolation layer, respectively.

7. The antenna structure according to claim 1, wherein a vertical distance from the first base substrate to the isolation layer is equal to a vertical distance from the second base substrate to the isolation layer.

8. The antenna structure according to claim 1, wherein the first base substrate, the second base substrate and the isolation layer are parallel to each other.

9. A communication device, comprising an antenna structure, wherein the antenna structure comprises:

a first base substrate;

a second base substrate arranged opposite to the first base substrate;

a dielectric layer provided between the first base substrate and the second base substrate;

an isolation layer provided between the first base substrate and the second base substrate and configured to divide the dielectric layer into a first dielectric layer and a second dielectric layer in a direction perpendicular to the first base substrate;

a plurality of first coplanar electrodes provided on one side of the isolation layer facing the first dielectric layer and including a plurality of first electrodes and a plurality of second electrodes alternately arranged;

a plurality of second coplanar electrodes provided on another side of the isolation layer facing the second dielectric layer and including a plurality of third electrodes and a plurality of fourth electrodes alternately arranged;

wherein the plurality of first coplanar electrodes is disposed orthogonally opposite the plurality of second coplanar electrodes;

a plurality of first separate buffer blocks provided between the first coplanar electrodes and the isolation layer; and a plurality of second separate buffer blocks provided between the second coplanar electrodes and the isolation layer;

wherein materials of at least one of the first buffer blocks or the second buffer blocks include an organic polymer material.

10. A method for manufacturing an antenna structure, comprising:

providing a first base substrate and a second base substrate;

filling a dielectric material between the first base substrate and the second base substrate;

forming an isolation layer in the dielectric material, to form a first microcavity and a second microcavity in a space between the first base substrate and the second base substrate in a direction perpendicular to the first base substrate;

forming a plurality of first coplanar electrodes and a plurality of second coplanar electrodes respectively on two sides of the isolation layer, in which the plurality of first coplanar electrodes include a plurality of first electrodes and a plurality of second electrodes alternately arranged; and the plurality of second coplanar electrodes include a plurality of third electrodes and a plurality of fourth electrodes alternately arranged; and forming a plurality of first separate buffer blocks and a plurality of second separate buffer blocks between the isolation layer and the plurality of first coplanar electrodes and the plurality of second coplanar electrodes, respectively and correspondingly;

wherein the plurality of first coplanar electrodes is disposed orthogonally opposite the plurality of second coplanar electrodes, and materials of at least one of the first buffer blocks or the second buffer blocks include an organic polymer material.

11. The method for manufacturing the antenna structure according to claim 10, wherein the dielectric layer includes polymer dispersed liquid crystals (PDLCs).

12. The method for manufacturing the antenna structure according to claim 10, wherein a material of the isolation layer includes a conductive polymer composite material.

13. The method for manufacturing the antenna structure according to claim 10, wherein the plurality of first coplanar electrodes include metal electrodes, and the plurality of second coplanar electrodes include metal electrodes.

14. The method for manufacturing the antenna structure according to claim 10, wherein the orthographic projection of the first coplanar electrode on the isolation layer is completely coincident with the orthographic projection of the corresponding second coplanar electrode on the isolation layer.

15. The method for manufacturing the antenna structure according to claim 10, wherein a vertical distance from the first base substrate to the isolation layer is equal to a vertical distance from the second base substrate to the isolation layer.

* * * * *